US007234533B2

(12) United States Patent
Gambier

(10) Patent No.: US 7,234,533 B2
(45) Date of Patent: Jun. 26, 2007

(54) WELL PACKER HAVING AN ENERGIZED SEALING ELEMENT AND ASSOCIATED METHOD

(75) Inventor: Philippe Gambier, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 78 days.

(21) Appl. No.: 10/763,565

(22) Filed: Jan. 23, 2004

(65) Prior Publication Data

US 2005/0072579 A1 Apr. 7, 2005

Related U.S. Application Data

(60) Provisional application No. 60/508,721, filed on Oct. 3, 2003.

(51) Int. Cl.
*E21B 33/12* (2006.01)

(52) U.S. Cl. ..... 166/387; 166/196; 166/207

(58) Field of Classification Search ..... 166/196, 166/387, 179, 207, 206
See application file for complete search history.

(56) References Cited

U.S. PATENT DOCUMENTS

| | | | | | |
|---|---|---|---|---|---|
| RE7,244 | E | * | 7/1876 | Martin | 277/331 |
| 2,216,268 | A | * | 10/1940 | Fritsche | 73/152.41 |
| 2,781,852 | A | | 2/1957 | Rumble | |
| 2,945,541 | A | | 7/1960 | Maly et al. | 166/187 |
| 3,070,167 | A | * | 12/1962 | Lindsey et al. | 166/153 |
| 3,374,838 | A | * | 3/1968 | Current | 166/123 |
| 3,918,523 | A | | 11/1975 | Stuber | 166/285 |
| 4,403,660 | A | | 9/1983 | Coone | 166/387 |
| 4,424,865 | A | * | 1/1984 | Payton, Jr. | 166/302 |
| 4,515,213 | A | * | 5/1985 | Rogen et al. | 166/123 |
| 5,044,855 | A | * | 9/1991 | Fukubayashi | 411/386 |
| 5,195,583 | A | | 3/1993 | Toon et al. | 166/187 |
| 5,236,201 | A | | 8/1993 | Vance, Sr. et al. | 277/34 |
| 5,297,633 | A | | 3/1994 | Snider et al. | 166/387 |
| 5,904,354 | A | * | 5/1999 | Collins | 277/328 |
| 5,941,313 | A | * | 8/1999 | Arizmendi | 166/387 |
| 6,123,148 | A | * | 9/2000 | Oneal | 166/118 |
| 6,446,717 | B1 | * | 9/2002 | White et al. | 166/187 |
| 2002/0157831 | A1 | * | 10/2002 | Kurlenya et al. | 166/302 |
| 2002/0189696 | A1 | * | 12/2002 | Simpson et al. | 138/89 |
| 2002/0195244 | A1 | * | 12/2002 | Coronado et al. | 166/196 |
| 2003/0047880 | A1 | | 3/2003 | Ross | |
| 2003/0062170 | A1 | * | 4/2003 | Slack | 166/377 |
| 2004/0069504 | A1 | * | 4/2004 | Krueger et al. | 166/387 |
| 2005/0000692 | A1 | * | 1/2005 | Cook et al. | 166/300 |
| 2005/0056429 | A1 | * | 3/2005 | Du et al. | 166/311 |
| 2006/0113088 | A1 | * | 6/2006 | Richard et al. | 166/384 |

FOREIGN PATENT DOCUMENTS

| | | |
|---|---|---|
| EP | 0428422 A2 | 5/1991 |
| EP | 0 428 422 B1 | 1/1998 |

(Continued)

*Primary Examiner*—William Neuder
*Assistant Examiner*—Nicole A Coy
(74) *Attorney, Agent, or Firm*—Fred G. Pruner; Dona C Edwards; Bryan P Galloway

(57) ABSTRACT

The present invention provides for a seal assembly that maintains a seal under various conditions by providing a source of stored energy that can be used to insure contact forces are maintained.

22 Claims, 3 Drawing Sheets

FOREIGN PATENT DOCUMENTS

| | | | |
|---|---|---|---|
| GB | 1331797 | A | 9/1973 |
| GB | 2 371 064 | | 7/2002 |
| GB | 2371064 | A | 7/2002 |
| GB | 2 372 526 | | 8/2002 |
| GB | 2372526 | A | 8/2002 |
| GB | 2 398 313 | | 8/2004 |
| GB | 2398313 | A | 8/2004 |
| GB | 2 399 367 | | 9/2004 |
| GB | 2399367 | A | 9/2004 |
| WO | 02/20941 | A1 | 3/2002 |
| WO | WO 02/20941 | | 3/2002 |
| WO | 02/077411 | A1 | 10/2002 |
| WO | WO 02/077411 | | 10/2002 |

* cited by examiner

WELL PACKER HAVING AN ENERGIZED SEALING ELEMENT AND ASSOCIATED METHOD

This application claims the benefit of U.S. Provisional Patent Application No. 60/508,721, filed on Oct. 3, 2003.

BACKGROUND OF THE INVENTION

1. Field of Invention

The present invention relates to the field of well packers, and particularly to a device and method for energizing a well packer seal element.

2. Related Art

Packers are used in oil and gas wells to prevent fluid flow through an annulus formed by a tubing within the well and the wall of the wellbore or casing. The packer is generally integrally connected to the tubing, using, for example, means such as a threaded connection, a ratch-latch assembly, or a J-latch, all of which are well known in the art. The tubing/packer connection generally establishes the seal for the inner radius of the annulus.

The seal for the outer radius of the annulus is generally established by a deformable element such as rubber or an elastomer. A compressive force is generally applied to the deformable element, causing it to extrude radially outward. The element extends from the outer portion of the packer to the wellbore wall or casing and seals between those structures. Sometimes backup rings are used to prevent undesired extrusion in the axial direction. The deformable element may also incorporate other components such as a metallic mesh or garter spring.

Existing seal elements sometimes fail due to differences in thermal expansion properties of the deformable element and the surrounding casing or formation. Generally the rubber or elastomer contracts more in response to a decrease in temperature than does the casing, for example. That can lead to a decrease in contact force and a leak may result.

Another failure mode common in open hole completions involves a long sleeve of rubber that is inflated to produce the necessary contact force to form a seal against the surrounding formation. If pressure is not maintained on the inner wall of the sleeve, the seal is likely to fail.

Another type of packer found in the existing art is the steep pitch helix packer described in U.S. Pat. No. 6,296,054. That packer relies on helical strips that expand radially outward in response to an applied action to produce the desired seal.

SUMMARY

The present invention provides for an energized sealing element that maintains a seal under various conditions by providing a source of stored energy that can be used to insure contact forces are maintained.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

The present invention comprises numerous embodiments and associated methods for creating an energized seal as further described below. The seal element of the present invention is for use in downhole packer applications and may be employed on a variety of packers. For example, the seal element may be used on an open hole-type packer, or it may be used on a packer for use inside a casing, liner, or tubing. In addition, the seal element may be employed on an expandable tubing packer.

Figure 1:
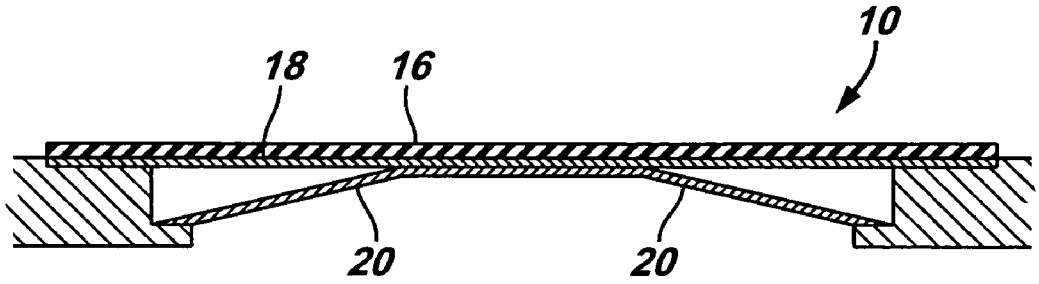
FIG. 1 illustrates an embodiment of a seal element constructed in accordance with the present invention.

In the embodiment of FIG. 1, an energized seal element 10 comprises a seal layer 16, a support sleeve 18, and an energizing element 20. Seal layer 16 is preferably made of rubber or an elastomeric compound, but can be made of thermoplastic or various soft, deformable materials, or metals such as copper or steel capable of forming a metal-to-metal seal. Often only a thin layer of elastomer, rubber, or other seal material is used. Use of a thin layer helps prevent a problem that may occur due to differences in thermal expansion of metal or rock and rubber.

Support sleeve 18 and energizing element 20 are preferably made of metal, but can be made of various materials such as composite materials that permit the storage of mechanical potential energy. The stored potential energy maintains the contact force needed to create the seal. A shape-memory alloy that assumes an expanded state when exposed to a predetermined temperature may also be used.

Figure 2A:
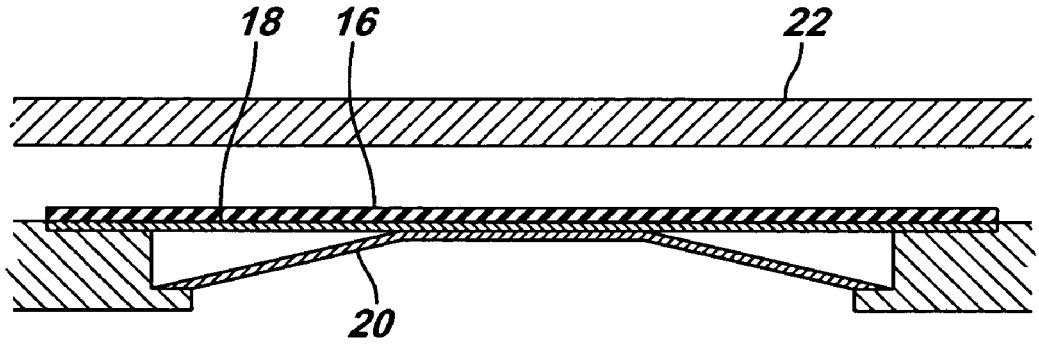
FIGS. 2A and 2B illustrate the seal element of FIG. 1 when the seal element is acted on by a compressive force.
Figure 2B:
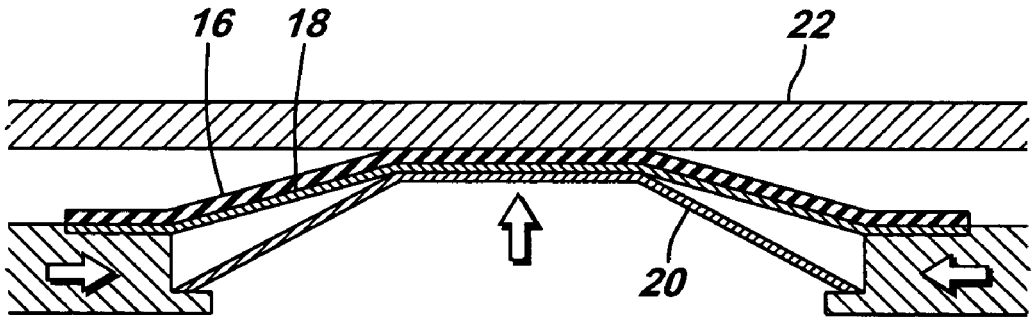

As shown in FIGS. 1, 2A, and 2B, seal layer 16 is placed over support sleeve 18. Support sleeve 18 covers energizing element 20.

Various combinations of those structures are possible. For example, sealing layer 16 could in some cases be omitted altogether. In such cases, support sleeve 18 provides the sealing surface to seal against a wall 22. This is possible, for example, in an open-hole section of a borehole if the open-hole section is composed of soft materials and support sleeve 18 is able to penetrate some distance into the borehole. Also, support sleeve 18 may be embedded in seal layer 16 (i.e., within the elastomer itself). In other cases it may be desirable to omit support sleeve 18 such that energizing element 20 bears directly onto seal layer 16.

In packers, it is common to compress the seal element to expand the seal into sealing engagement with an outer conduit (e.g., casing or open hole section). Other methods of expanding are also used. For ease of description, the following discussion will primarily focus on the compression type of actuation and engagement. In a compression-set packer, a mandrel typically moves to create the compressive force.

Referring to FIGS. 2A and 2B, when seal element 10 is compressed, energizing element 20 pushes support sleeve 18 in a radially outward direction to force seal layer 16 into engagement with wall 22. Energizing element 16 deforms elastically (at least in part) when compressed, and creates a reserve of energy that keeps support sleeve 18 pressed radially outward.

Any of the embodiments herein may use a bi-metallic material to increase the force applied by energizing element 20. A bimetallic material may be designed to deform in a certain direction as the energizing element is exposed to higher (or lower) temperatures.

Figure 3:
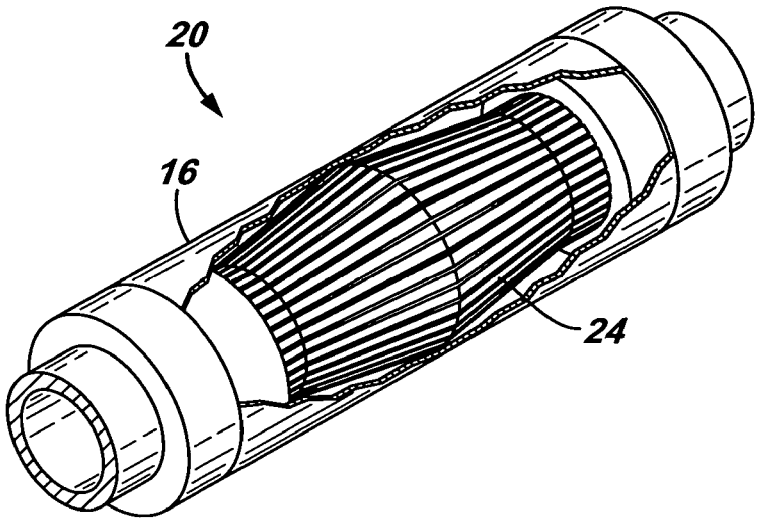
FIG. 3 is a perspective view of an alternate embodiment constructed in accordance with the present invention.

As stated above, support sleeve 18 is not always necessary. For example, energizing element 20 and seal layer 16 may be designed to prevent the seal layer 16 from extruding through any openings in energizing element 20. FIG. 3 shows an example of such an embodiment. Energizing element 20 comprises slotted members 24 and the seal layer 16 encloses energizing element 20.

Seal element 10 may be precisely located and can produce high contact forces. In an open hole this allows the seal to penetrate the formation. In a cased hole, this will increase the sealing capacity.

There are many ways to energize seal element 20. In one embodiment, energizing element 20 may be a spring 26 placed behind support sleeve 18. Spring 26 may be a coil-type, wound tightly and held in place by a pin or weld. Once seal element 10 is in the proper position, spring 26 may be released to uncoil and expand, thereby providing a radially energizing action against seal layer 16.

Energizing element 20 may also comprise a bi-stable element such as a bi-stable expandable tubing expanded behind the seal layer 16. A bi-stable expandable tubing is described in U.S. published application no. US20020092658, published Jul. 18, 2002, and incorporated herein by reference.

In another embodiment, energizing element 20 is a swelling material positioned behind support sleeve 18. For example, energizing element 20 may be a material that swells when exposed to some other material. Once the packer is in the desired position, the swelling material is mixed with a reactant and caused to swell. The swellable energizing element 20 may be used in conjunction with a standard setting mechanism or the energizing elements discussed above. For example, the packer may be set by compression and then energized further with a swellable material.

In another embodiment, energizing element 20 could be a bag or container which is energized with gas or other compressible material and placed beneath seal layer 16. The bag can be compressed at its ends once the packer is in the proper position downhole. The compression of the bag will cause the bag to compress lengthwise and expand radially to energize the seal element 10. A gas chamber or spring behind a piston could maintain the compression to keep the seal energized.

Figure 4A:
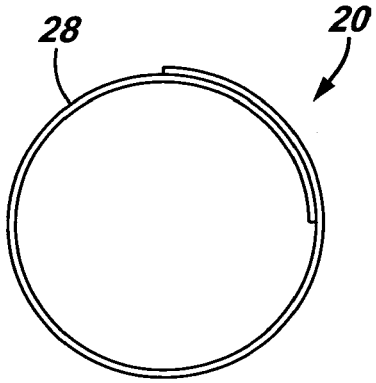
FIGS. 4A and 4B illustrate an energizing element in accordance with an embodiment of the present invention.
Figure 4B:
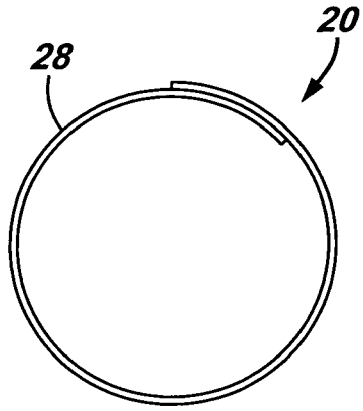

A spiral spring 28 as shown in FIGS. 4A and 4B can be used as energizing element 20. This option could be constructed of either a long length of metal or as a succession of small independent springs. FIG. 4A shows spring 28 in its compressed state and FIG. 4B shows spring 28 in its expanded state.

Figure 5A:
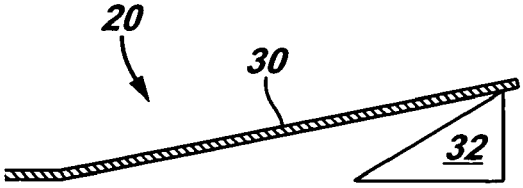
FIGS. 5A and 5B illustrate an energizing element in accordance with an embodiment of the present invention.
Figure 5B:
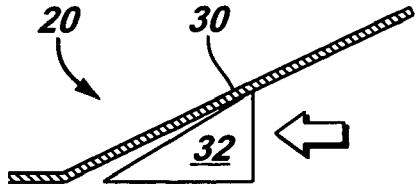

Another option would be to use a bow 30 as energizing element 20, as shown in FIGS. 5A. and 5B Bow 30 will move outward when engaged by wedge 32. When bow 30 contacts support sleeve 18, bow 30 will elasticity deform and store mechanical energy.

Figure 6:
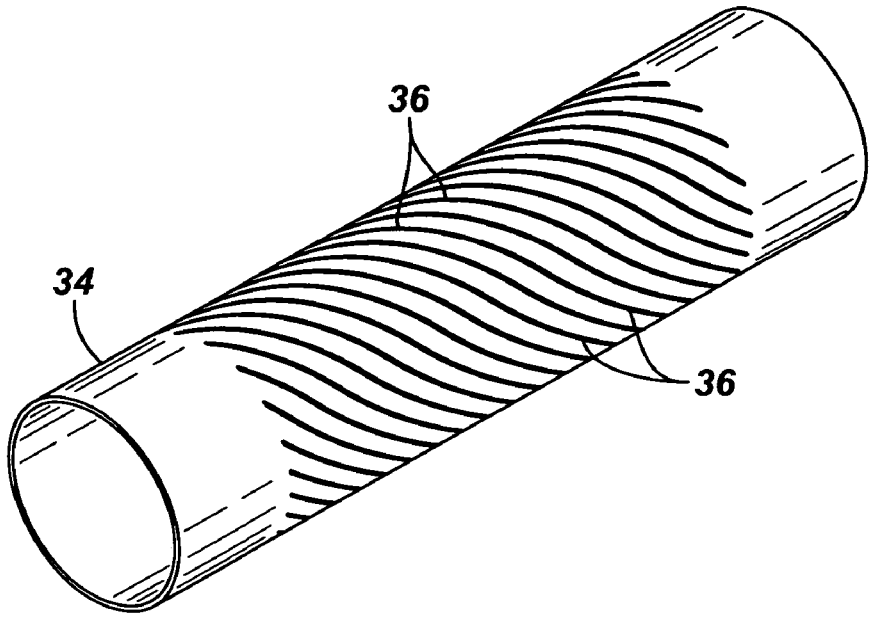
FIG. 6 illustrates an energizing element in accordance with an embodiment of the present invention.

Instead of using piecewise parts, a tube 34 with slots 36 can be used. Slots 36 can be helical or straight. FIG. 6 shows tube 34 with helical slots 36. Tube 34 will expand when compressed axially.

Multiple layers of tubes 34 or energizing elements 20 could be used to increase the energy stored.

In addition, the present invention may provide alternate flow paths and cable/control line feed-throughs, and it may provide a housing for intelligent completion devices, such as sensors or remote actuation devices. The invention can be used with expandable sand screens and in formation isolation completions.

Figure 7:
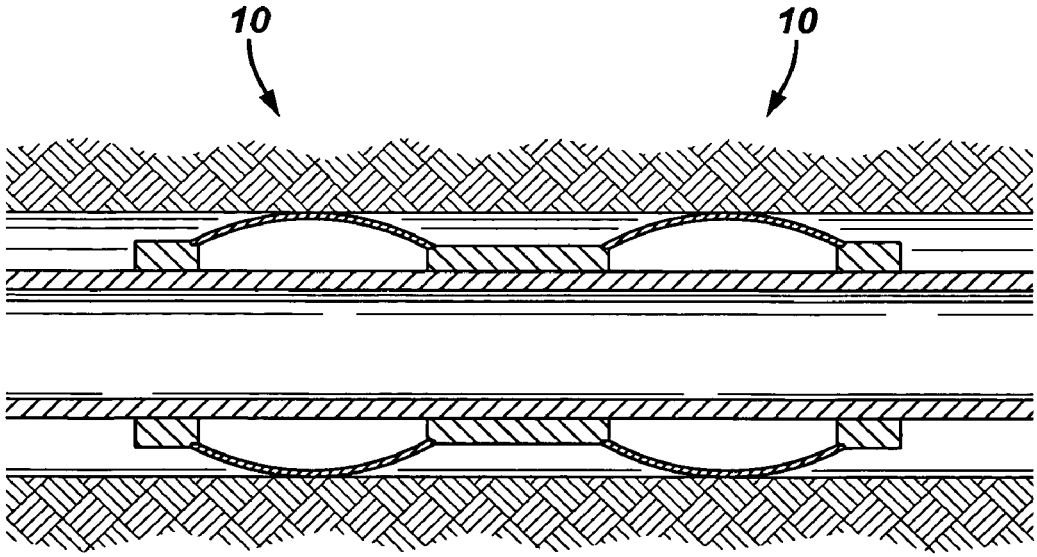
FIG. 7 illustrates a plurality of seal elements configured in accordance with an embodiment of the present invention.

Referring to FIG. 7, if several seals elements 10 are placed in series (i.e., two or more that are longitudinally offset), they will provide sealing redundancy and an opportunity to test the seals by placing a pressure gauge between the two seals and applying pressure within that confined space. The change in pressure will yield information regarding the porosity of the surrounding rock and the integrity of each seal.

Another application is to inject fluid between the seals. This will allow an operator to inject chemicals to, for example, transform a soft, porous formation into a tight formation, increasing the efficacy of the seal not only at the seal face, but also in the vicinity of the packer near the injection site. Cement or some other chemical could be injected there.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A seal element for use in a packer deployed in a well, comprising:

a support sleeve;

a sealing layer at least partially enclosing the support sleeve; and a tube comprising slots, the tube adapted to radially extend against the support sleeve in response to the tube being axially compressed to press the sealing layer against a wall enclosing the packer to establish a sealing contact between the sealing layer and the wall.

2. The seal element of claim 1, wherein the slots comprise helical slots.

3. The seal element of claim 1, wherein the tube is adapted to expand when compressed axially.

4. The seal element of claim 1, further comprising at least one additional tube comprising slots located radially outside of the first tube.

5. A seal element usable with a packer, comprising:

a support sleeve;

a sealing layer at least partially enclosing the support sleeve;

a bow adapted to remain retracted while the packer is run into a well and radially extend against the support sleeve to press the sealing layer against a wall that encloses the packer to form a sealing contact between the sealing layer and the wall; and a wedge adapted to engage the bow to radially extend the bow.

6. A method usable with a well, comprising:

providing a packer comprising a support sleeve, a sealing layer at least partially enclosing the support sleeve and a tube comprising slots; and radially expanding the tube against the support sleeve in response to the tube being axially compressed to press the sealing layer against a wall enclosing the packer to establish a sealing contact between the sealing layer and the wall.

7. The method of claim 6, wherein the act of providing comprises providing a packer comprising a tube comprising helical slots.

8. The method of claim 6, wherein the act of providing comprises providing a packer comprising a tube comprising slots that extend generally axially with respect to a longitudinal axis of the tube.

9. The method of claim 6, further comprising forming multiple slotted tube layers, said tube comprising slots being one of the multiple slotted tube layers.

10. A seal element usable with a packer, comprising:

a support sleeve;

a sealing layer at least partially enclosing the support sleeve;

a bow having an inner surface and an outer surface; and a moveable element adapted to extend radially inside the bow to contact the inner surface of the bow to cause the bow to radially extend outwardly against the support sleeve such that the outer surface of the bow presses the sealing layer against a wall that encloses the packer to form a sealing contact between the sealing layer and the wall.

11. The seal element of claim 10, wherein the moveable element comprises a wedge.

12. The seal element of claim 10, wherein the bow is adapted to elastically deform in response to contacting the support sleeve to store mechanical energy to keep the sealing layer in sealing contact with the wall.

13. A method usable with a well, comprising:

providing a packer having a seal element, a support sleeve, a sealing layer at least partially enclosing the support sleeve and a moveable element; and moving the moveable member radially inside the bow to contact an inner surface of the bow to cause the bow to radially extend outwardly against the support sleeve to press the sealing layer against a wall that encloses the packer to form a sealing contact between the sealing layer and the wall.

14. The method of claim 13, wherein the act of moving comprises moving a wedge radially inside the bow.

15. The method of claim 13, further comprising elastically deforming the bow in response to the bow contacting the support sleeve to store mechanical energy to keep the sealing layer in sealing contact with the wall.

16. A seal element for use in a packer comprising:

an energizing element adapted to store potential energy prior to the packer being run to a predetermined position in a well the energizing element comprising a spring;

a sealing layer covering at least a portion of the energizing element; and a mechanism adapted to hold the energizing element in a first position prior to the packer being run into the well to store the potential energy and release the energizing element downhole in the well to release at least some of the potential energy at the predetermined position to radially expand the energizing element and establish contact between the sealing layer and a wall enclosing the packer.

17. The seal element of claim 16, in which the energizing element comprises a metallic substrate.

18. The seal element of claim 16, in which the energizing element comprises a composite material.

19. The seal element of claim 16, wherein the mechanism comprises a pin.

20. The seal element of claim 16, further comprising a support sleeve disposed around the energizing element.

21. A method usable with a well comprising:

storing potential energy in a seal element of a packer before deploying the packer downhole in the well;

after the storing, running the packer into the well;

positioning the packer at a position at which a seal is to be formed in an annulus of the well;

setting the packer by releasing at least some of the potential energy to form a seal between the packer and a wall surrounding the packer; and maintaining the seal using at least some of the potential energy remaining in the potential energy stored in the seal element.

22. The method of claim 21, in which the storing is performed by at least deforming an elastic substrate of the seal element.

* * * * *